United States Patent [19]

Wolf

[11] 4,058,314

[45] Nov. 15, 1977

[54] HOOP AND DISC WITH SOUNDERS

[76] Inventor: Frank K. Wolf, 3228 N. Sacramento, Chicago, Ill. 60618

[21] Appl. No.: 757,483

[22] Filed: Jan. 6, 1977

[51] Int. Cl.[2] ..... A63B 65/10

[52] U.S. Cl. ..... 273/106 B; 46/52; 273/1 R

[58] Field of Search ..... 273/1 R, 1 E, 1 M, 106 R, 273/106 B; 46/47, 52, 174, 74 D

[56] References Cited

U.S. PATENT DOCUMENTS

| | | | |
|---|---|---|---|
| 1,404,132 | 1/1922 | Manes | 273/106 B |
| 3,395,462 | 8/1968 | Sebree | 46/174 X |
| 3,523,387 | 8/1970 | Smith | 46/52 |
| 3,590,518 | 7/1971 | LeBaron | 273/106 B X |
| 3,673,731 | 7/1972 | Farhi et al. | 46/47 |
| 3,708,911 | 1/1973 | Haschek | 46/47 |
| 3,900,986 | 8/1975 | Torres | 46/74 D |
| 3,900,987 | 8/1975 | Holt | 273/106 B X |
| 3,959,915 | 6/1976 | Kettlestrings | 46/74 D |
| 4,031,655 | 6/1977 | Ponciano et al. | 46/52 |

FOREIGN PATENT DOCUMENTS

| | | | |
|---|---|---|---|
| 819,559 | 7/1937 | France | 273/106 B |

*Primary Examiner*—Paul E. Shapiro

[57] ABSTRACT

This game consists primarily of five rubber or plastic rings of tubular structure, which vary in size. The rings include spherical bells which may be removed therefrom, and a disk may be placed in the center of the rings, the disk being provided with fixed whistles for producing sound.

5 Claims, 3 Drawing Figures

FIG. 1
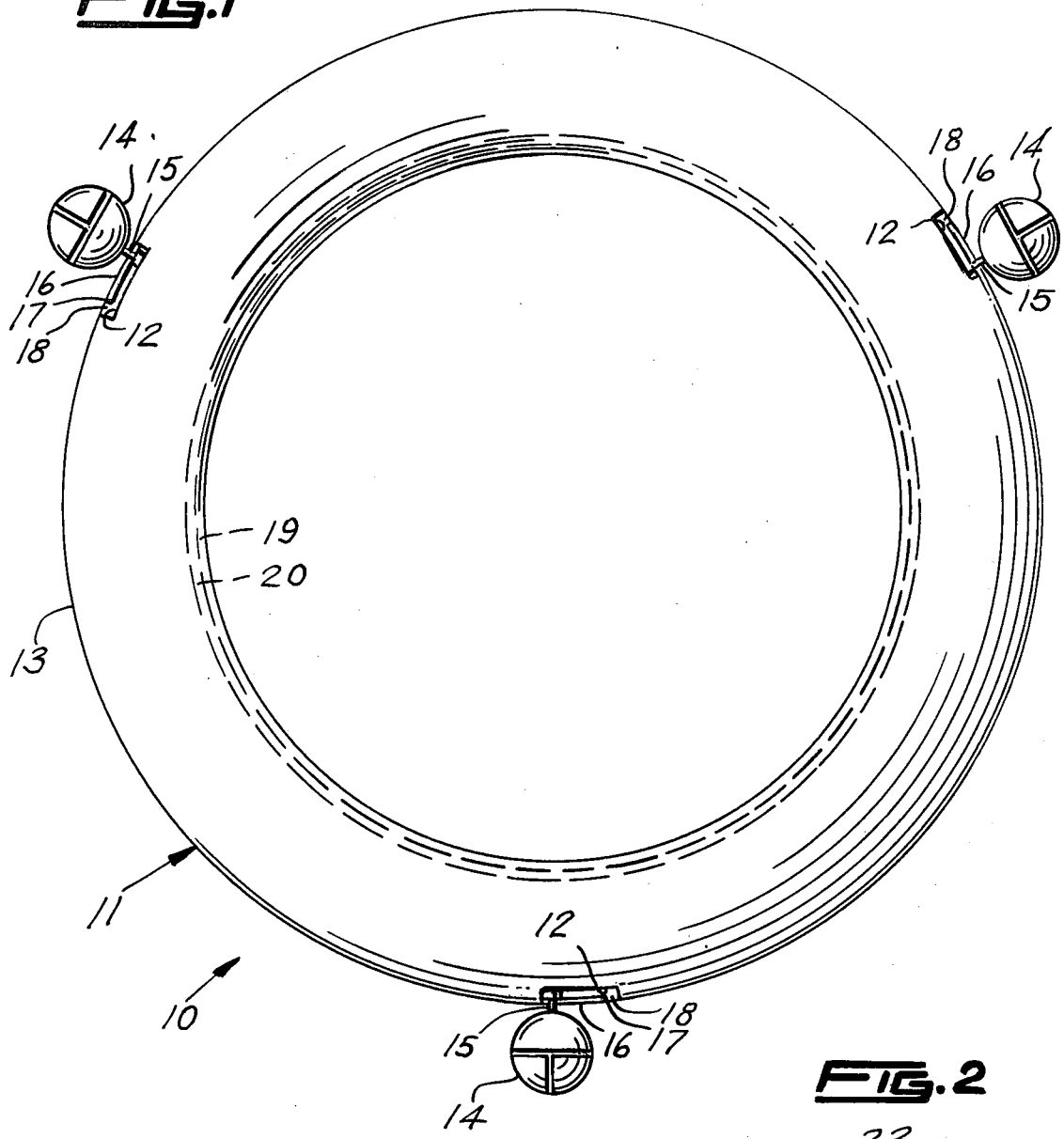
FIG. 2
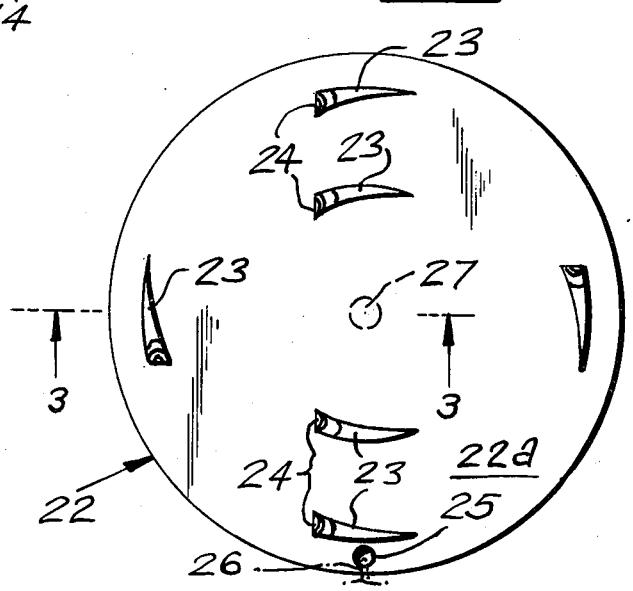
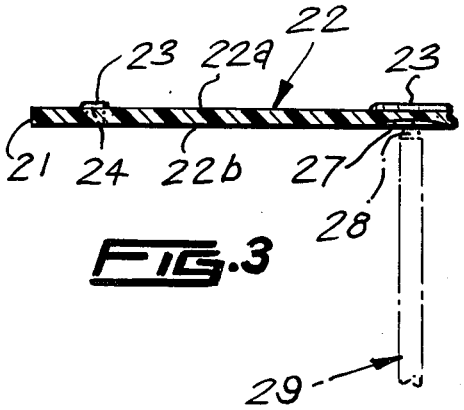
FIG. 3

HOOP AND DISC WITH SOUNDERS

This invention relates to game toys, and, more particularly, to a game for children and adults.

The principal object of this invention is to provide a game for children and adults, which will be unique and novel, so as to provide recreation for those using it.

Another object of this invention is to provide a game of the type described, which may be used indoors or outdoors and it will have audible sound means employed therein.

A further object of this invention is to provide a game of the type described, which will consist of a tubular construction with removable disk means therein.

Other objects of the invention are to provide a game for children and adults, which is simple in design, inexpensive to manufacture, rugged in construction, easy to use and efficient in operation.

These, and other objects, will be readily evident upon a study of the following specification and the accompanying drawing, wherein:

FIG. 1 is a plan view of the present invention showing one size of ring that will be used;

FIG. 2 is a plan view of a disk attachment for FIG. 1, which is shown on a smaller scale, and FIG. 3 is a cross-sectional view taken along the line 3—3 of FIG. 1, showing a juggler stick in phantom lines.

According to this invention, a game 10 is shown to include a circular ring 11 which is also circular in cross-sectional configuration. Ring 11 is of rubber or plastic material and is provided with equally and radially spaced apart openings 12 on its outer periphery 13, which receive, each, a spherical bell 14. The hook 15 of each bell 14, is frictionally and removably received on a projection 16, which is disposed within the opening 12 and is integral with ring 11. The end 17 of projection 16, and one end portion of opening 12, defines a space 18 so as to receive the hook of bell 14.

Ring 11 is provided with an annular thread 19 and slot 20, combination, which serves the purpose of removably and threadingly receiving the outer periphery 21 of disk 22. Disk 22 on one surface **22*a*, has a plurality of flute like portions 23 for providing an audible sound when air is introduced into the opening 24 which will hereinafter be described. Near the outer periphery 21 of disk 22, is an opening 25 for receiving a card 26, and on surface 22*b*, is a central and concave recess 27 which may receive point 28 of stick 29, so as to enable the user to juggle disk 22**.

It shall be noted, that bells 14 may be from three to five different sizes and the rings 11, are five in number and each is tubular in construction. Two of the rings 11 are 6 inches in diameter, two are eight inches in diameter, and one is 10 inches in diameter. The thickness of the rings 11 may vary from 1–2 inches in cross-sectional thickness.

In use, after placing all the bells 14 in the openings 12, the smaller rings 11 are placed on the user's arms rotated. The next size is held in the user's hands. When the first two rings are in the middle of the user's underarms, the next size is put on and rotated. After four rings 11 are rotating on the user's arms, they will pick up the largest ring 11 with one foot and start it to rotating. The bells 14, when the rings 11 are rotating, will provide a musical sound effect.

One can also mark eight to eleven fields on the ground outdoors, and hop from one field to another, on foot while rotating the rings 11, not touching the line, or the next player will commence with the same procedure.

For another outdoor use, the bells are removed from the openings 12. The game is then played alone, or with others, using different techniques.

For throwing the ring 11 for height or distance, but not for catching it, the disk 22 is placed into the thread 19 and slot 20 combination. When the ring 11 and disk 22 combination is thrown, a flute like sound is emitted from the flute portions 22 by air passing through the openings 24 thereof.

The above-mentioned flute like sound may be used on any modified form of the device which may be flown in the manner described.

The disk 22 may be used in a whirling fashion, by placing the cord 26 in the opening 25, and holding the opposite end of the cord 26 in the user's hand. The whirling motion will produce the same flute like sound as heretofore described.

While various changes may be made in the detail construction, it is understood that such changes will be within the spirit and scope of the present invention as is defined by the appended claims.

What I claim is:

1. A game, comprising a separatable combination of a tubular and circular ring and a disk, said ring having removably received thereon, musical sound producing means, and said disk is provided with fixed sound producing means.

2. The combination according to claim 1, wherein said ring includes on its outer periphery, equally and radially spaced apart projections, said projections being integral of said ring at its outer periphery, and said projections are disposed within elongated openings of the outer periphery of said ring.

3. The combination according to claim 2, wherein said projections extend from one end of said openings and is spaced apart from the opposite end of said openings which defines space means for removably receiving said musical sound producing means, which consist of a bell which has hook means thereon that frictionally receives said projection, and said bells when said ring is rotated on the limb of a person, produces sound.

4. The combination according to claim 3, wherein the inner peripheral opening of said ring includes an annular groove and thread combination which removably receives the outer periphery of said disk so as to enable said separatable combination to be used for sailing aerodynamically when tossed by the user.

5. The combination according to claim 4, wherein the said disk of said separatable combination is provided with raised members that produce audible sound, said raised members being radially spaced apart on one of the surfaces of said disk and opening means in one end of said raised members intersects opening means through said disks through which air passes when said disk is in flight by being tossed by the user, and said disk is provided with a concaved recess on the opposite side which is centrally disposed therein for receiving a stick so as to be juggled by the user, and said disk includes an opening, offset therethrough for removably receiving a cord so as to enable the user to swing said disk in an arc.

* * * * *